United States Patent [19]

Briner et al.

[11] Patent Number: 4,680,924

[45] Date of Patent: Jul. 21, 1987

[54] METHOD OF STARTING SPINNING OF A YARN IN A FRICTION SPINNING DEVICE

[75] Inventors: Emil Briner; Richard Hieronymi, both of Winterthur, Switzerland

[73] Assignee: Rieter Machine Works Limited, Winterthur, Switzerland

[21] Appl. No.: 922,683

[22] Filed: Oct. 24, 1986

[30] Foreign Application Priority Data

Oct. 31, 1985 [CH] Switzerland ..... 04685/85

[51] Int. Cl.[4] ..... D01H 15/02; D01H 7/885

[52] U.S. Cl. ..... 57/263; 57/401; 57/411

[58] Field of Search ..... 57/263, 301, 401, 408, 57/409, 411

[56] References Cited

U.S. PATENT DOCUMENTS

| | | | |
|---|---|---|---|
| 4,070,811 | 1/1978 | Fehrer | 57/411 X |
| 4,367,623 | 1/1983 | Parker et al. | 57/263 |
| 4,541,234 | 9/1985 | Wassenhoven | 57/401 X |
| 4,570,430 | 2/1986 | Stahlecker | 57/263 |
| 4,570,434 | 2/1986 | Stahlecker | 57/411 |
| 4,612,763 | 9/1986 | Stahlecker | 57/301 |
| 4,628,685 | 12/1986 | Stahlecker et al. | 57/263 |
| 4,633,660 | 1/1987 | Artzt et al. | 57/263 |

FOREIGN PATENT DOCUMENTS

| | | |
|---|---|---|
| 0110150 | 6/1984 | European Pat. Off. . |
| 3308250 | 9/1984 | Fed. Rep. of Germany . |
| 3445422 | 7/1985 | Fed. Rep. of Germany . |

*Primary Examiner*—Donald Watkins

*Attorney, Agent, or Firm*—Werner W. Kleeman

[57] ABSTRACT

In order to start or recommence spinning of a yarn in a friction spinning device, the following method steps are carried out upon start-up of a new spinning operation or upon piecing after a thread break: fibers separated by an opening device are delivered by means of a fiber transporting passage to a rotating friction spinning drum and are twisted to form a twisted fiber structure; when the twisted fiber structure has substantially reached a predeterminate diameter or size, then the twisted fiber structure is transported by an airstream delivered by a pressure duct towards and into a guide tube and is forwarded therein into a convergent space of rotating withdrawal rolls; and the twisted fiber structure is caught at production speed by these withdrawal rolls and delivered on a divergent side of the withdrawal rolls to a receiving suction device which transfers the spun yarn subsequent to the twisted fiber structure to further processing elements.

12 Claims, 8 Drawing Figures

METHOD OF STARTING SPINNING OF A YARN IN A FRICTION SPINNING DEVICE

CROSS REFERENCE TO RELATED APPLICATION

This application is related to the commonly assigned, copending patent application Ser. No. 06/874,521, filed June 16, 1986, now U.S. Pat. No. 4,646,513 and entitled "METHOD FOR PIECING A YARN IN A FRICTION SPINNING DEVICE".

BACKGROUND OF THE INVENTION

The present invention broadly relates to a new and improved method of starting or recommencing spinning of a yarn in a friction spinning device in which freely floating fibers in a fiber feed passage are delivered to a friction spinning surface of a friction spinning device or means and are forwarded on this friction spinning surface to a yarn formation position from which a spun yarn is withdrawn by a yarn withdrawal means.

The previously known methods and devices for starting or recommencing of spinning of a yarn in the aforementioned manner employ a yarn end brought back or returned from a package. For purposes of starting or recommencing spinning, this yarn end is returned to the stationary friction spinning device or means so that thereafter starting of spinning can be carried out by feeding fibers to the returned yarn end at reduced speed of the friction spinning device or means. It has also been proposed that before the start of spinning, that is before the feed of freely floating fibers to the inserted yarn end, the latter be untwisted by a corresponding motion of the friction spinning device or means in the opposite direction, so that the delivered fibers can thus be better bound or interlaced with the yarn end.

Such a device is known from the German Patent Publication No. 3,318,687, published Nov. 29, 1984 in which a yarn end from a reverse-rotated package is taken up by a suction device, and the yarn thus drawn in is held by means of two reciprocating devices in a convergent gap of two stationary friction spinning drums.

Before supplying freely floating fibers to this yarn, the latter is opened by reverse rotation of the friction spinning drum, so that the fibers of the yarn lie in a substantially twist-free condition in the convergent space of the friction spinning drums. Thereafter, the friction spinning drums are set in operation at reduced speed in the normal direction of rotation, and freely floating fibers are supplied to the opened yarn. The yarn thus produced is withdrawn at a correspondingly reduced speed and is passed to a joining or knotting means.

In order to take up the continually delivered yarn during the time required for the joining or knotting operation, the yarn is drawn in by a suction nozzle functioning as a yarn store.

After completion of joining or knotting, the complete device is accelerated to operating speed and thereafter disconnected from the required auxiliary drive means and is driven at operating speed by the normal drive means.

The disadvantage of such a device lies in the multiplicity of auxiliary equipment for the start-spinning procedure.

SUMMARY OF THE INVENTION

It is therefore, with the foregoing in mind, a primary object of the present invention to provide a method for starting or recommencing spinning of a yarn in a friction spinning device which is uncomplicated and can be carried out with relatively simple means.

In order to implement this and still further objects of the invention, which will become more readily apparent as the description proceeds, the method of starting or recommencing spinning of a yarn in a friction spinning device is manifested by the features that it comprises the steps of forwarding the freely floating fibers to the yarn formation position and twisting the freely floating fibers to form a rotating twisted fiber structure of substantially predeterminate size, forwarding the rotating twisted fiber structure by a first airstream towards the yarn withdrawal means and subsequently catching the rotating twisting fiber structure as well as spun yarn adjoining thereon by a yarn take-up means arranged subsequent to the yarn withdrawal means.

The advantages achieved by the invention are substantially that a device for carrying out the method can be relatively simple as a result of the possibility of performing start-spinning at production speed.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
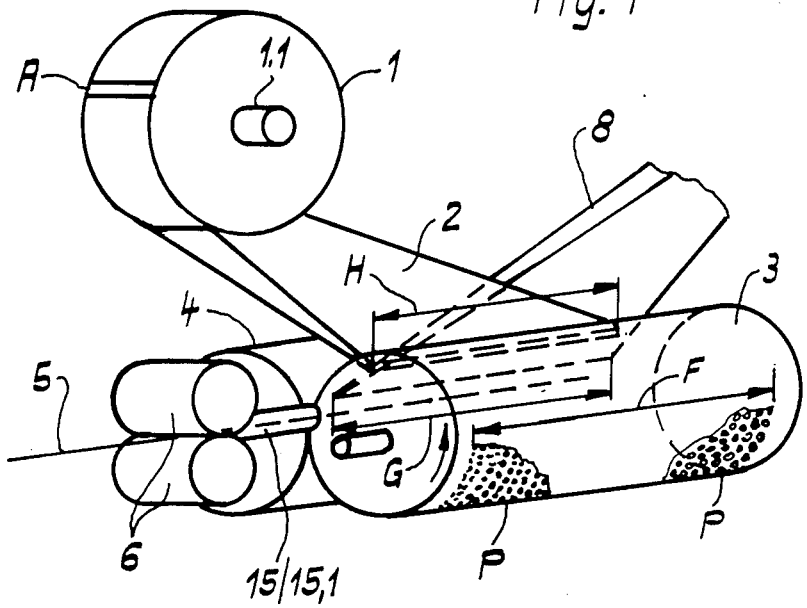
FIG. 1 shows a friction spinning device, semi-schematically illustrated in perspective view.
Figure 2:
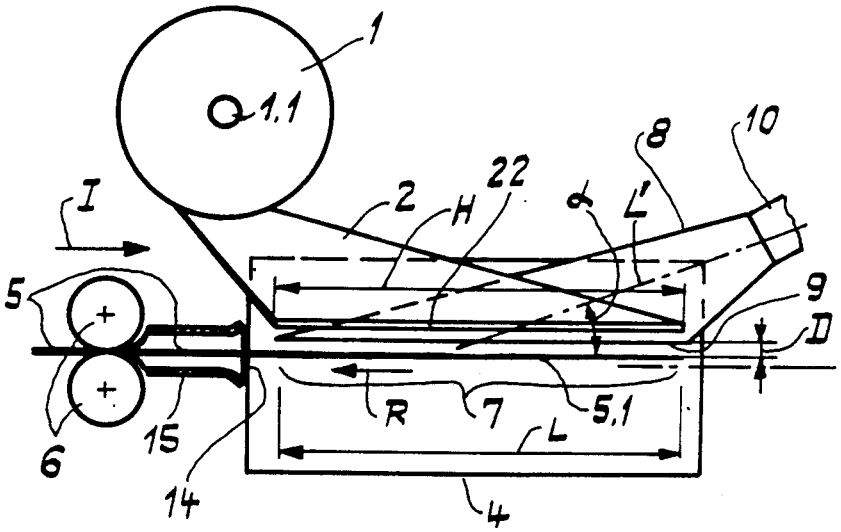
FIG. 2 shows part of the friction spinning device of FIG. 1 illustrated in the longitudinal direction.

Describing now the drawings, it is to be understood that in order to simplify the showing thereof, enough of the structure of the friction spinning device or means has been illustrated therein as is needed to enable one skilled in the art to readily understand the underlying principles and concepts of this invention. Turning specifically to FIG. 1 of the drawings, the apparatus illustrated therein by way of example and not limitation and employed to realize the method as herein-before described will be seen to comprise a fiber sliver opening device 1 known from the rotor open-end spinning process. The fiber sliver opening device 1 comprises an opening roller generally indicated by its drive shaft 1.1 and an infeed opening A provided for receiving a fiber sliver (not shown). Freely floating fibers 11 are delivered through a fiber feed or transport passage or duct 2 adjoining the opening device 1 by an airstream flowing through the fiber transport passage 2 to a perforated friction spinning drum 3 which is rotatable and suitably drivable. On this perforated friction spinning drum 3, a yarn end 5.1 which is being developed into a spun yarn 5, is formed in a known manner at a yarn formation position or location 7 (FIG. 2). A counter-roller 4 (which is also rotatable and drivable) assists the twisting-in of the fibers 11 located in the convergent space of the two rollers defined by the perforated friction spinning drum 3 and the counter-roller 4 at the yarn formation position 7. The counter-roller 4 does not contact the perforated friction spinning drum 3, but is arranged substantially very close thereto (for example at a spacing of between 0.05 and 0.15 mm) and substantially parallel thereto. The spun yarn 5 is withdrawn by a yarn withdrawal means in the form of a rotating withdrawal roller pair 6.

Such devices are known from previous publications in the patent literature and will therefore not be further described in detail. For example, British Patent No. 1,231,198 shows a basically similar process in which, however, a perforated disc is provided instead of a perforated roller and a frusto-conical counter-roller is provided in place of a cylindrical one.

Furthermore, in addition to the fiber transport passage or duct 2, a pressure air duct 8 opens onto the yarn formation position or location 7 in the convergent space of the two friction spinning drums 3 and 4 (also called friction spinning rollers 3 and 4 and also sometimes called perforated friction spinning drum 3 and counter-roller 4). The length G of an exit opening 9 of the pressure air duct 8 corresponds at least to the length F (FIG. 1) of a perforated region of the perforated friction spinning drum 3, while the length H of an exit opening 22 of the fiber transport passage 2 corresponds at most to the length F of this perforated region. The perforated region is designated by the reference character P in FIG. 1, and is conveniently illustrated only partially.

The relation of the distance D or D1 (FIG. 3, FIG. 3*a*) between the exit opening 9 and the yarn end 5.1 located in the yarn formation position 7 to the intensity of air flow at this exit opening 9 of the pressure air duct 8 must be determined empirically on the basis of the subsequently described method steps of the start-spinning operation. It will be understood that the term "start-spinning operation" as used herein includes, when appropriate, both commencement of spinning and recommencement of spinning after piecing up a yarn after a yarn or thread break.

The same applies to the width (not referenced) and the form of the exit opening 9 of the pressure air duct 8 in order to be able to render selectively variable the intensity of the air flow at the exit opening 9; the expression "form" of the exit opening 9 refers to the shape of the exit opening area. For example, the width of the exit opening 9 can be varied within the length G of the exit opening 9 in order to thereby obtain differences in the blowing effect along the exit opening 9.

The pressure air duct 8 also has a connector 10 by means of which this pressure air duct 8 can be connected to a non-illustrated suitable pressure air supply with all known required elements for regulating the air pressure and air quantity and for controlling the air flow.

Figure 3:
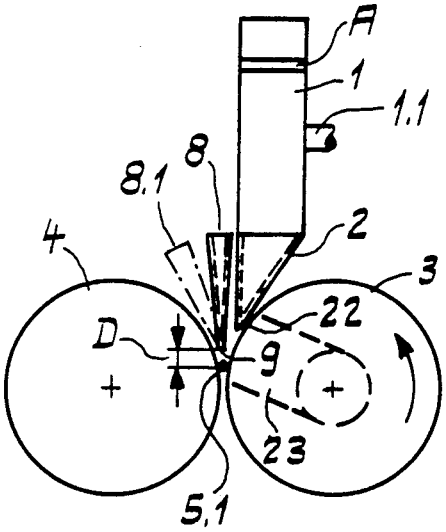
FIG. 3 shows part of the friction spinning device of FIG. 1 in frontal view as seen in the direction of the arrow I of FIG. 2.
Figure 3A:
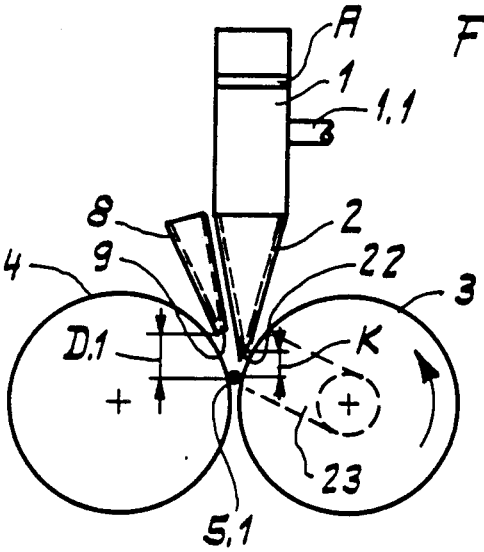
FIG. 3*a* shows a modification of the friction spinning device of FIG. 3.

In FIG. 3*a*, the spacing D.1 indicates that the exit opening 9 of the pressure air duct 8 can be spaced further from the yarn end 5.1 than the exit opening 22 of the fiber transport passage or duct 2 which is spaced at the distance K.

Furthermore, the dash-dotted lines in FIG. 3 schematically indicate a further pressure air duct 8.1 showing that the disposition of the pressure air duct is not strictly limited to the disposition of the pressure air duct 8 represented in full lines in the drawings, without any appreciable detrimental effect in the subsequently described blowing action or effect.

In the following description, the procedure for starting-spinning is described both for a new spinning start-up and also for piecing after a thread-break i.e. recommencing the spinning operation.

It is first noted that the previously mentioned air flow or airstream in the fiber transport passage 2, for transporting or forwarding the freely floating fibers 11 from the conventional opening roller forming part of the opening device 1 to the friction spinning drum 3, is created in known manner by a suction nozzle 23 located in the friction spinning drum 3. The suction nozzle 23 generates a suction air flow or airstream at the surface of the friction spinning drum 3 over the length F of the perforated drum region or surface P. The yarn end 5.1, on the one hand, and the exit opening 22 of the fiber transport passage 2 on the other hand, are located within this suction airstream.

Figure 5:
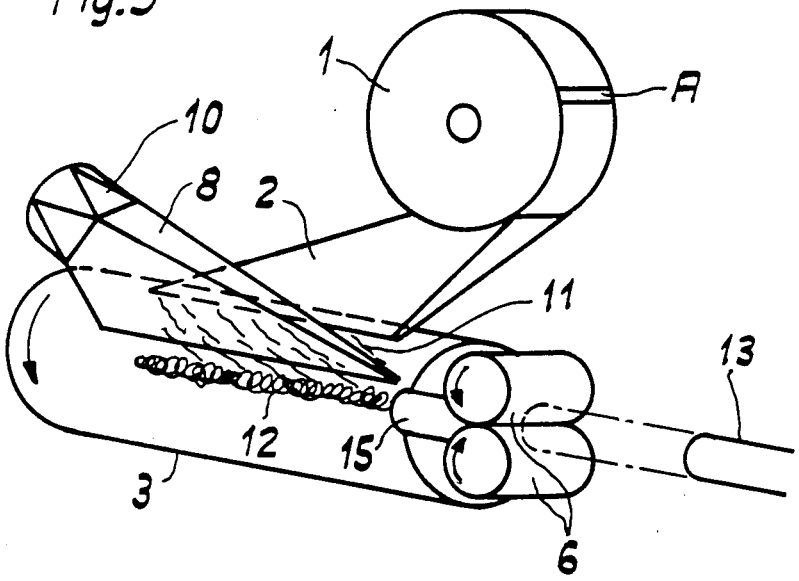
FIG. 5 partially shows the friction spinning device of FIG. 1 from the opposite side, illustrated at one process stage of the start-spinning operation.

As shown in FIG. 5, during start-spinning, freely floating fibers 11 are first supplied or forwarded by means of the fiber transport passage 2 to the friction spinning drum 3, initially without withdrawal of these freely floating fibers 11 in the form of a yarn or the like, so that a rotating twisted fiber structure 12 is formed and becomes steadily larger.

The counter-roller 4 is not illustrated in FIG. 5 in order to show this rotating twisted fiber structure 12 more clearly.

Now, once this rotating twisted fiber structure 12 has reached a predeterminate or desired size then, on the one hand, a suction device 13 acting as a yarn take-up or removal means is moved toward the divergent side of the rotating withdrawal roller pair 6 rotating in the direction of the depicted arrows in such manner that this yarn take-up means or suction device 13 is able to take up the rotating twisted fiber structure 12 delivered by the rotating withdrawal roller pair 6.

On the other hand, after the rotating twisted fiber structure 12 has reached the predeterminate or desired size as already mentioned, pressure or pressurized air is delivered by the pressure air duct 8. The rotating twisted fiber structure 12 is delivered into an entry opening 14 of a guide tube 15 or guide means, and passes via this guide tube 15 or guide means into the convergent space of the rotating withdrawal roller pair 6.

As illustrated in FIG. 2, the guide tube 15 is provided between end faces of the friction rollers or perforated friction spinning drum 3 and counter-roller 4 and the withdrawal rollers or rotating withdrawal roller pair 6, in such manner that the axis of symmetry of the guide tube 15 lies substantially in an imaginary plane which contains the line of contact or nip of the two withdrawal rollers or rotating withdrawal roller pair 6 and a location on the perforated friction spinning drum 3 at which the spun yarn 5 leaves this perforated friction spinning drum 3.

The internal diameter of this guide tube or guide means 15 is larger than the external diameter of the previously mentioned twisted fiber structure or rotating twisted fiber structure 12, for example the internal diameter of the guide tube 15 may be, for instance, at least double the external diameter of the rotating twisted fiber structure 12.

A not particularly referenced exit opening of the guide tube 15 can, as illustrated in FIG. 2, be provided with cut-outs or coped out in such manner that this exit opening substantially conforms or is accommodated to the peripheral surface of the withdrawal rollers or rotating withdrawal roller pair 6.

Figure 4:
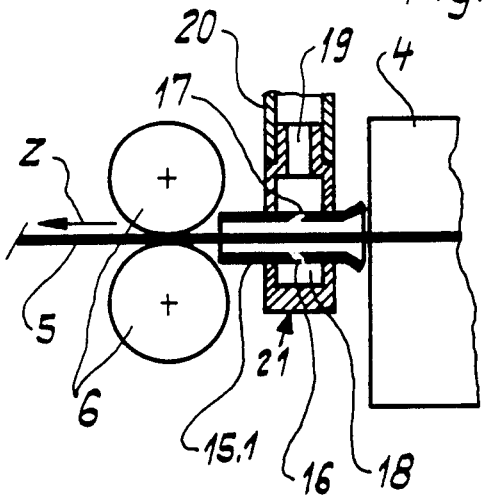
FIG. 4 shows a modification of part of the friction spinning device of FIG. 2 illustrated in section.

Furthermore, as illustrated in FIG. 4, the guide tube or guide means 15 can be formed as an injector guide tube 15.1 with inflow openings or jets 16 and 17 being provided thereat for inflow of pressure or pressurized air of, for instance, a selectable variable intensity. These air blowing-in or inflow openings 16 and 17 impart to an airstream guided by these inflow openings or jets 16 and 17 a component of force in the yarn withdrawal direction Z. The airstream is created by an annular pressure chamber 18 provided around these inflow openings 16 and 17 and standing under pressure. The annular pressure chamber 18 itself is supplied via a connector bore 19 with pressurized air from a suitable conventional pressure air system generally indicated by a connector tube 20 forming the final element thereof. The connector tube 20 or the like is fixedly connected to a pressure housing 21 containing the pressure chamber 18 and the connector bore 19.

The pressure casing or pressure housing 21 in turn serves to fixedly accommodate the injector guide tube 15.1 and seals the annular pressure chamber 18 against the atmosphere.

Accordingly, in comparison with the guide tube 15, the injector guide tube 15.1 has the advantage of positively forwarding the previously mentioned rotating twisted fiber structure 12 into the convergent space of the withdrawal rollers or rotating withdrawal roller pair 6 during the start-spinning operation.

Figure 6:
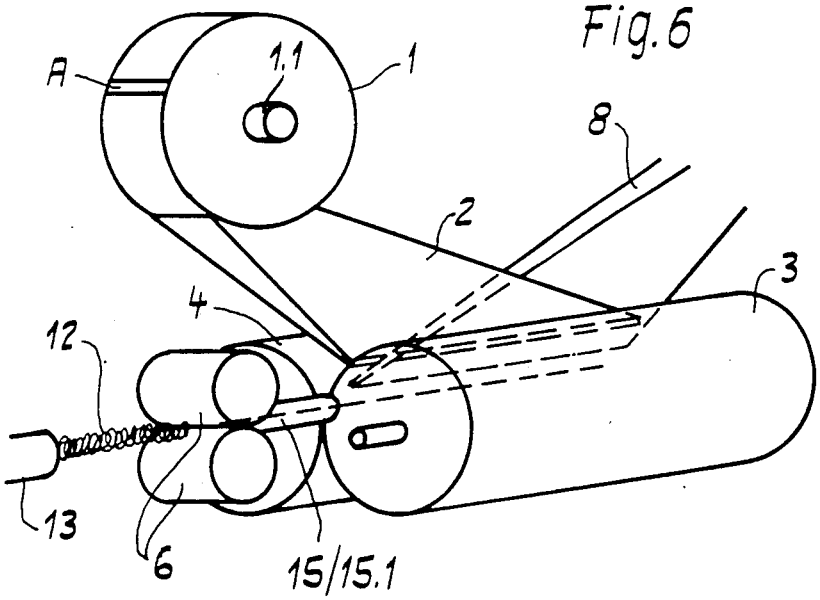
FIGS. 6 and 7 show the friction spinning device of FIG. 1 illustrated at process stages of the start-spinning operation.
Figure 7:
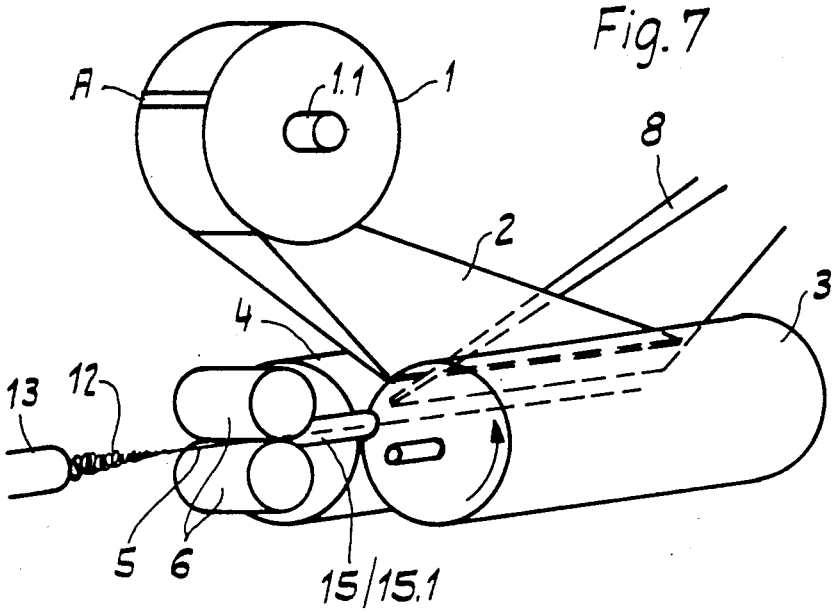

Upon leaving the withdrawal rollers or rotating withdrawal roller pair 6, the rotating twisted fiber structure 12 is caught and drawn in by the yarn take-up means or suction device 13, as illustrated in FIGS. 6 and 7.

The spun yarn 5 (see FIG. 7), which is subsequently also drawn in, is guided by means of this suction device 13 to the further elements forming part of the spinning machine (not shown) but which will not be additionally described here.

As soon as the rotating twisted fiber structure 12 is caught by the suction device 13, the airstream in the pressure air duct 8 and the airstream in the injector guide tube 15.1 are interrupted or terminated.

The previously mentioned start-spinning procedure can be carried out at full production speed so that the spun yarn 5 delivered or forwarded by the withdrawal rollers or rotating withdrawal roller pair 6 corresponds to the spun yarn 5 to be produced.

Clearly, the described method can also be carried out with friction spinning devices which, in place of friction spinning drums, have a friction spinning disc to which the freely floating fibers 11 are transported and by which the spun yarn 5 is formed in a yarn formation position or location 7, being withdrawn therefrom by withdrawal rollers or a rotating withdrawal roller pair 6. Such a device is illustrated and described, for example, in the previously mentioned British Patent No. 1,231,198.

It is also possible to use an appropriately perforated belt in place of a perforated friction spinning drum or disc, on which perforated belt the freely floating fibers 11 are delivered to a yarn formation position or location 7 lying at right angles to the direction of belt movement in order to produce a spun yarn 5.

Such a device, with such a band or belt, is illustrated for example in French published patent application No. 2,480,799.

Furthermore, in place of the suction device 13, a mechanical take-up device (not shown) can be used. The take-up device must merely be able to receive in the aforesaid manner the rotating twisted fiber structure 12 and the subsequently following spun yarn 5 at production speed.

Furthermore, the effect of an airstream or air flow delivered by the pressure air duct 8 at predetermined intensity (which on the one hand is capable of catching a rotating twisted fiber structure 12 of predeterminate size and transporting or forwarding it towards the withdrawal rollers or rotating withdrawal roller pair 6) has proved to only become operative when the rotating twisted fiber structure 12 has attained an adequate size which, however, must be determined empirically.

It can therefore be concluded that the airstream from the pressure air duct 8 can also be started before, e.g. by the amount of a predeterminate time period, or simultaneously with the transport or forwarding of freely floating fibers 11 to the perforated friction spinning drum 3.

Furthermore it has been found that the airstream does not have a negative influence on the spun yarn 5 produced after the start-spinning operation.

Correspondingly, a selection can be made as to the sequence of starting fiber feed and supplying the airstream or of maintaining or switching-off the airstream after, i.e. subsequent to the expiration of a predeterminate time period, the start-spinning operation.

Advantageously, the sequence is so selected that first the freely floating fibers 11 are supplied or forwarded and the airstream is then switched on only after the achievement of a rotating twisted fiber structure 12 of desired or predetermined size.

In addition, the switching-on of the airstream before the delivery or forwarding of the freely floating fibers 11 can be used to clean the surface of the perforated friction spinning drum 3 and the counter-roller 4, if necessary. In correspondence with the previously described arrangements, this cleaning airstream can selectively be maintained before the delivery or forwarding of the freely floating fibers 11, or can be switched off prior to such delivery or forwarding.

In FIG. 2, the dash-dotted line L′ indicates the central line of flow of the airstream guided in the pressure air duct 8. As indicated by the angle $\alpha$, this line of flow L′ is so inclined to the yarn end 5.1 that the airstream or air flow creates a component of force R directed towards the rotating withdrawal roller pair 6 and acting on the rotating twisted fiber structure 12. The angle $\alpha$ is advantageously selected to be less than 45 degrees.

While there are shown and described present preferred embodiments of the invention, it is to be distinctly understood that the invention is not limited thereto, but may be otherwise variously embodied and practiced within the scope of the following claims. Accordingly,

What we claim is:

1. A method for starting or recommencing spinning of a yarn in a friction spinning device in which freely floating fibers are delivered through a fiber transport passage to a friction spinning surface of a friction spinning means and are forwarded on said friction spinning surface to a yarn formation position from which a spun yarn is withdrawn by yarn withdrawal means, said method comprising the steps of:

forwarding said freely floating fibers to said yarn formation position and twisting said freely floating fibers to form a rotating twisted fiber structure of substantially predetermined size;

forwarding said rotating twisted fiber structure by a first airstream towards said yarn withdrawal means; and subsequently catching said rotating twisted fiber structure, and spun yarn adjoining thereon, by a yarn take-up means arranged subsequent to said yarn withdrawal means.

2. The method as defined in claim 1, wherein:

said step of forwarding said freely floating fibers to said yarn formation position for forming said rotating twisted fiber structure is performed subsequent to the expiration of a predetermined time period following initiation of said airstream.

3. The method as defined in claim 2, further including the step of:

employing said airstream for cleaning the friction spinning surface of said friction spinning means before said step of forwarding said freely floating fibers.

4. The method as defined in claim 3, wherein:

said step of employing said airstream for cleaning the friction spinning surface of said friction spinning means before forwarding of said freely floating fibers entails subsequently terminating said airstream.

5. The method as defined in claim 1 wherein:

said step of forwarding said freely floating fibers to said yarn formation position for forming said rotating twisted fiber structure is performed simultaneously with initiation of said airstream.

6. The method as defined in claim 1, wherein:

said step of forwarding said freely floating fibers to said yarn formation position for forming said rotating twisted fiber structure is performed prior to commencement of a predetermined time period preceding initiation of said airstream.

7. The method as defined in claim 1, further including the step of:

initiating a second airstream for forwarding said rotating twisted fiber structure from said yarn formation position to said yarn withdrawal means.

8. The method as defined in claim 7 wherein:

said second airstream is terminated after said rotating twisted fiber structure has been forwarded towards said yarn withdrawal means.

9. The method as defined in claim 7, wherein:

said first airstream for forwarding said rotating twisted fiber structure toward said yarn withdrawal means has an adjustable intensity; and said second airstream for forwarding said rotating twisted fiber structure between said yarn formation position and said yarn withdrawal means having an adjustable intensity.

10. The method as defined in claim 1, wherein:

said first airstream is terminated after said rotating twisted fiber structure has been forwarded towards said yarn withdrawal means.

11. The method as defined in claim 1, wherein:

said friction spinning means has a production speed; and the start-spinning operation being performed at said production speed of said friction spinning means.

12. The method as defined in claim 1, wherein:

said first airstream has a central line of flow; and said central line of flow being inclined at a predetermined angle less than 45 degrees relative to said spun yarn such that said first airstream creates a component of force for forwarding said rotating twisted fiber structure towards said yarn withdrawal means.

* * * * *